US006471553B2

(12) United States Patent
Kasai

(10) Patent No.: US 6,471,553 B2
(45) Date of Patent: Oct. 29, 2002

(54) ELECTRICAL CONNECTION BOX CONTAINING BUS BARS

(75) Inventor: Koji Kasai, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 39 days.

(21) Appl. No.: 09/765,353

(22) Filed: Jan. 22, 2001

(65) Prior Publication Data

US 2001/0009825 A1 Jul. 26, 2001

(30) Foreign Application Priority Data

Jan. 26, 2000 (JP) ..... 2000-017097

(51) Int. Cl.[7] ..... H01R 11/09
(52) U.S. Cl. ..... 439/724
(58) Field of Search ..... 439/44, 49, 723, 439/724, 924, 76.2

(56) References Cited

U.S. PATENT DOCUMENTS 5,322,445 A * 6/1994 Ozaki et al. ..... 439/212
5,501,605 A * 3/1996 Ozaki et al. ..... 439/34
5,605,465 A * 2/1997 Kobayashi et al. ..... 439/76.2
5,624,280 A 4/1997 Kato
6,030,259 A * 2/2000 Yoshigi ..... 439/723

FOREIGN PATENT DOCUMENTS

GB 2 293 052 A 3/1996

* cited by examiner

*Primary Examiner*—Khiem Nguyen
(74) *Attorney, Agent, or Firm*—Oliff & Berridge, PLC

(57) ABSTRACT

An electrical connection box has upper and lower casing and locking components for locking the casings together in an assembled condition. An array of bus bars are mounted upright in the interior space of the casings. At least one of the casings has abutments pressing on the bus bars to maintain the bus bars in position. The bus bars urge the casings apart against the restraint of the locking components.

5 Claims, 8 Drawing Sheets

ELECTRICAL CONNECTION BOX CONTAINING BUS BARS

BACKGROUND OF THE INVENTION

1. Field of Invention

The invention relates to electrical connection boxes containing bus bars, particularly electrical boxes suitable for use in vehicles, for example automobiles.

2. Description of the Related Art

U.S. Pat. No. 5,624,280 discloses an electrical branch joint box having identical upper and lower casings in which an array of upright sheet bus bars is mounted, with terminals of the bus bars projecting through the casings into connector sockets at the exterior face of the casings. The casings have mutually engageable snap-fit locking components, to lock them together in the assembled condition with the bus bars held between them.

FIGS. 8 and 9 of the drawings illustrate diagrammatically a problem which arises with casings of electrical connection boxes having snap-fit locking components. In FIG. 8, the box 51 has an upper casing 52 and a lower casing 53. Wires and the like are accommodated in each of the upper and lower casings 52,53. Locking projections 54 are formed at the lower edge of the outer side surface of the upper casing 52. At the upper edge of the inner side surface of the lower casing 53, there are locking recesses 55 in which the projections 54 fit. Fitting of the projections 54 in the recesses 55 allows the upper and lower casings 52,53 to be fixedly joined to each other.

However, as shown in FIG. 9, the projection 54 is able to enter the recess 55 owing to its elastic deformation in a direction shown by an arrow F. To allow this reliably, it is necessary to provide a predetermined clearance amount C between the projection 54 and a part of the recess 55. Accordingly, there is looseness or play between the upper casing 52 and the lower casing 53 in correspondence to the length of the clearance C. As a result, due to vibrations generated during travel of a vehicle, the projection 54 and the recess 55 rub against each other to generate abnormal sounds.

In an electrical connection box having vertical bus bars disclosed in Japanese Laid-Open Patent Application No. 7-135717, two casing are joined by fitting them together, as illustrated in FIG. 9, and the resulting looseness between the two casings causes the vertical bus bars accommodated in the box to loosen. Therefore, vibration of the electrical connection box due, for example, to vibration of a vehicle, increases the risk that electrical contacts between tabs of the vertical bus bars and electric components connected to the tabs become defective.

SUMMARY OF THE INVENTION

It is an object of the invention to provide an electrical connection box capable of minimizing or preventing looseness between assembled upper and lower casings and looseness of the bus bars included between the upper and lower casings.

According to the invention, there is provided an electrical connection box having an upper casing, a lower casing and mutually engageable locking components on the upper and lower casings for locking the casings together in an assembled condition, the inner sides of the casings defining an interior space when in the assembled condition. A plurality of bus bars are mounted upright in the interior space.

At least one of the casings has at least one abutment pressing on the bus bars, when the casings are in the assembled condition and the locking components are engaged, in a manner that maintains the bus bars in desired positions and causes the bus bars to urge the casings apart against the restraint of the locking components.

The abutment or abutments pressing the bus bars are preferably projections or narrow rib-like bars, achieving contact with the bus bars at a small area, in order to provide a pressing force eliminating looseness and play.

In a preferred embodiment the bus bars have main longitudinal body portions of flat shape arranged upright in an array alongside each other and extending parallel to each other in a longitudinal direction, and the box has a plurality of the abutments in the form of longitudinal members each extending across the array of bus bars perpendicularly to the longitudinal direction of the bus bars, the members being spaced apart along the length of the bus bars.

In the invention, the reaction force generated by the engagement of the abutment or abutments and the bus bars urges the upper and lower casings apart. This prevents looseness or play at the locking components even though a clearance is provided between the locking components. The natural resilience and/or flexibility of the material of the casings permits the locking components to engage each other, while also allowing the bus bars to press the casings apart so as to eliminate looseness. Therefore, it is possible to prevent looseness between the upper and lower casings. The engagement force between the upright bus bars and the abutment or abutments thus also acts to prevent the bus bars from being loose in the casings. Thus, the bus bars can be reliably and securely placed at predetermined positions in the casings. The casings are typically made of a suitable electrically insulating plastic material having an inherent slight deformability.

If a plurality of abutments are arranged to act on the bus bars and extend transversely to the bus bar array and are disposed at predetermined intervals over the entire length of the bus bars, the array of bus bars are uniformly pressed in position, and the casings are urged apart in a balanced manner.

Pressure connection blades may be formed on the vertical bus bars so that by pressing an electrical wire against the pressure connection blades of adjacent or spaced bus bars, the bus bars can be electrically connected to each other. Such an arrangement makes it easy to electrically connect the bus bars and to design or alter a bus bar circuit. It is also easy to prevent the electric wire from being separated from the pressure connection blade as the bus bars are prevented from loosening. Accordingly, the reliability of the connection between electrical wires and the bus bars is improved.

The invention extends to use of the electrical connection box in a vehicle, for example, an automobile.

In this specification, including the claims, the directional terms "upper", "lower", etc. are used solely for convenience and clarity of description and definition. It is to be understood that the electrical connection box of the invention can be assembled and used in any orientation.

BRIEF DESCRIPTION OF THE DRAWINGS

An embodiment of the invention will now be described by way of non-limitative example with reference to the accompanying drawings, in which.

DETAILED DESCRIPTION OF THE PREFERRED EMBODIMENTS

Figure 1:
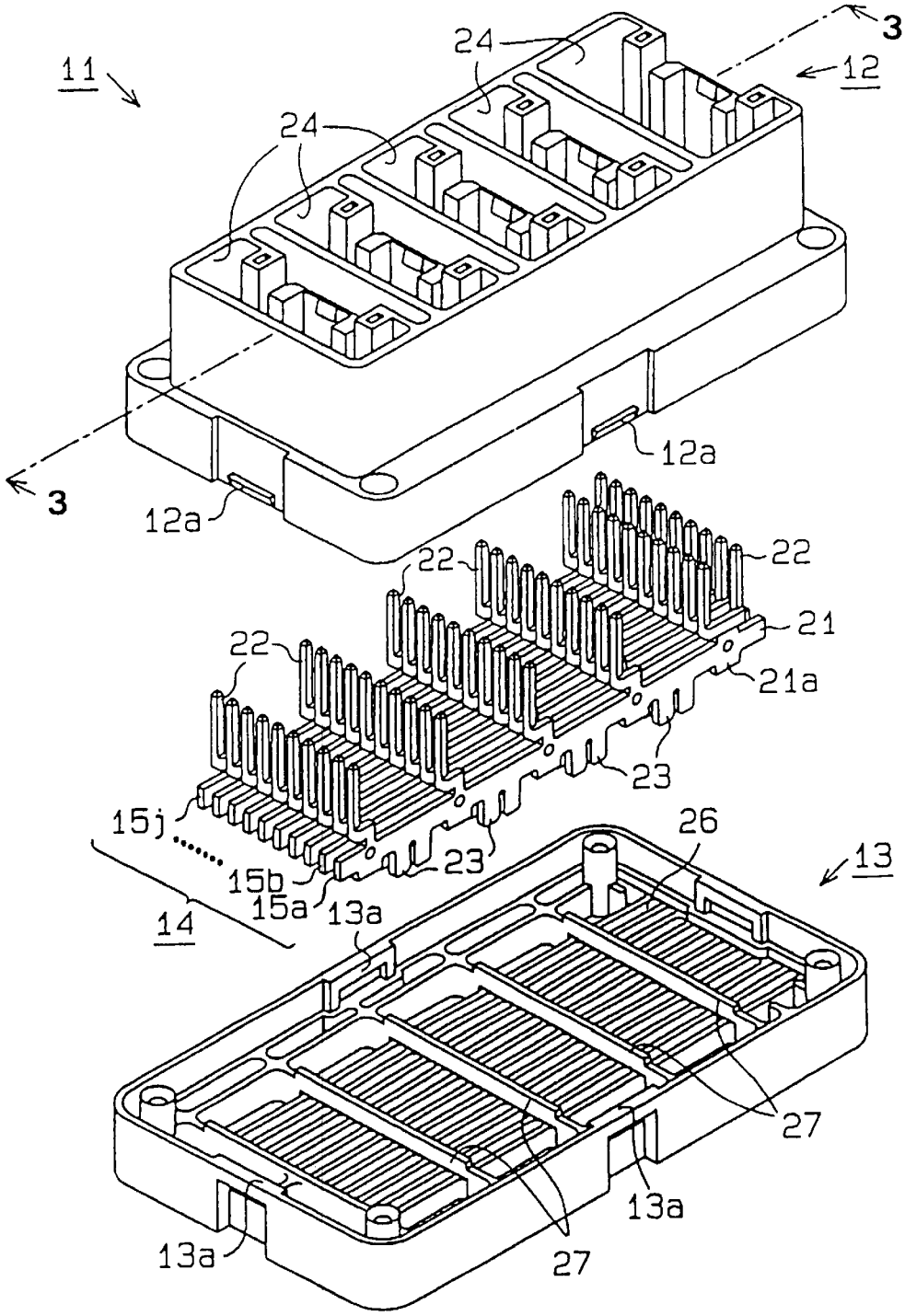
FIG. 1 is an exploded perspective view of an electrical connection box which is an embodiment of the invention.
Figure 2:
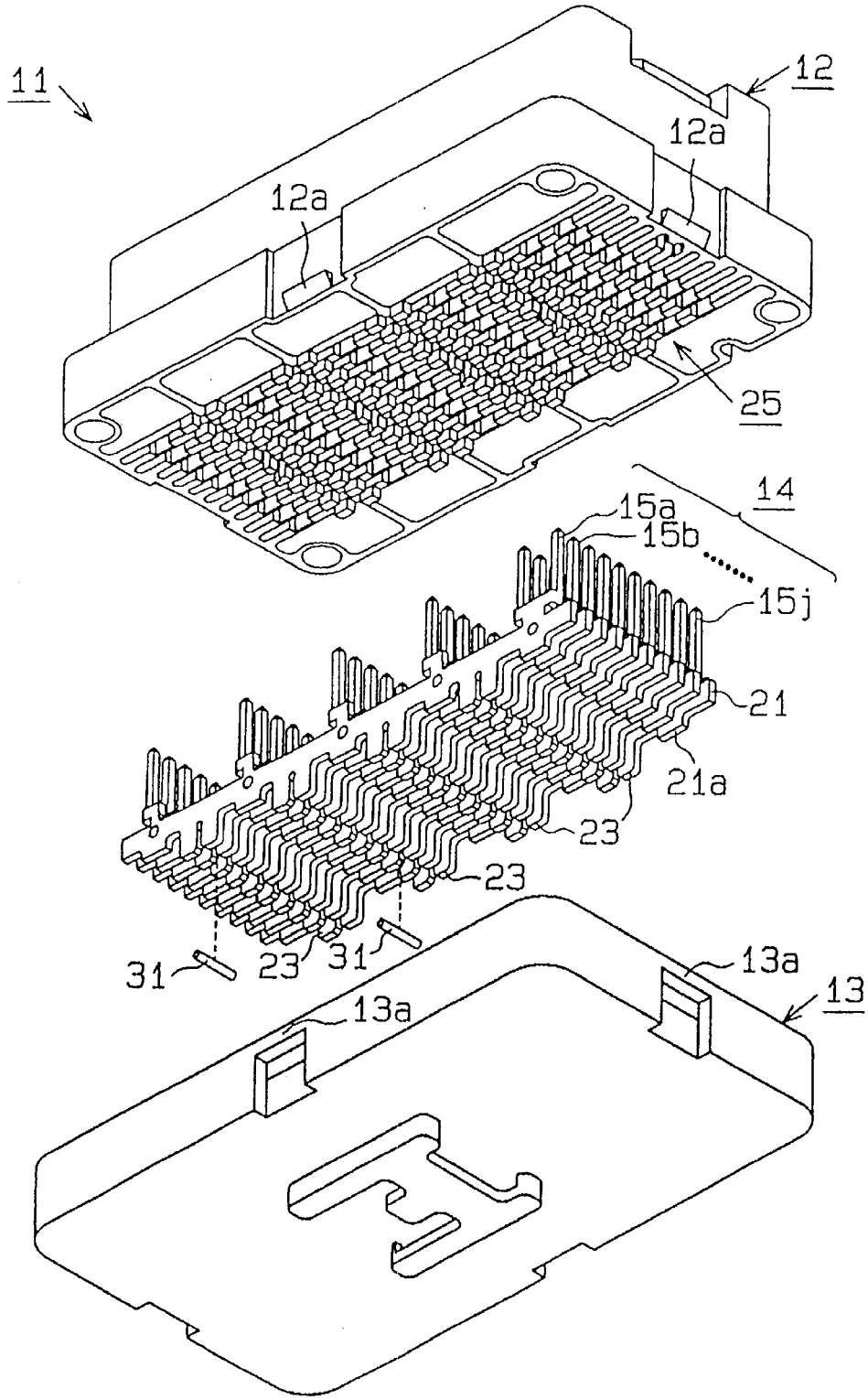
FIG. 2 is an exploded perspective view from below of the electrical connection box of FIG. 1.

As shown in FIGS. 1 and 2, an electric connection box 11 embodying aspects of the invention has an outer case constructed of an upper casing 12 and a lower casing 13 and an array 14 of bus bars housed in the assembled casings 12 and 13. The upper casing 12 and the lower casing 13 are one-piece molded parts made of synthetic resin and formed to attach to each other. More specifically, locking projections 12*a* are formed on outer side surfaces of the upper casing 12, and on inner side surfaces of the lower casing 13 there are molded shapes providing locking recesses 13*a* capable of receiving and locking in a snap-fit manner with the respective projections 12*a*, to securely attach the upper and lower casings 12,13. The material of the upper and lower casings 12,13 in this embodiment is PPT (polypropylene+talc).

Figure 6:
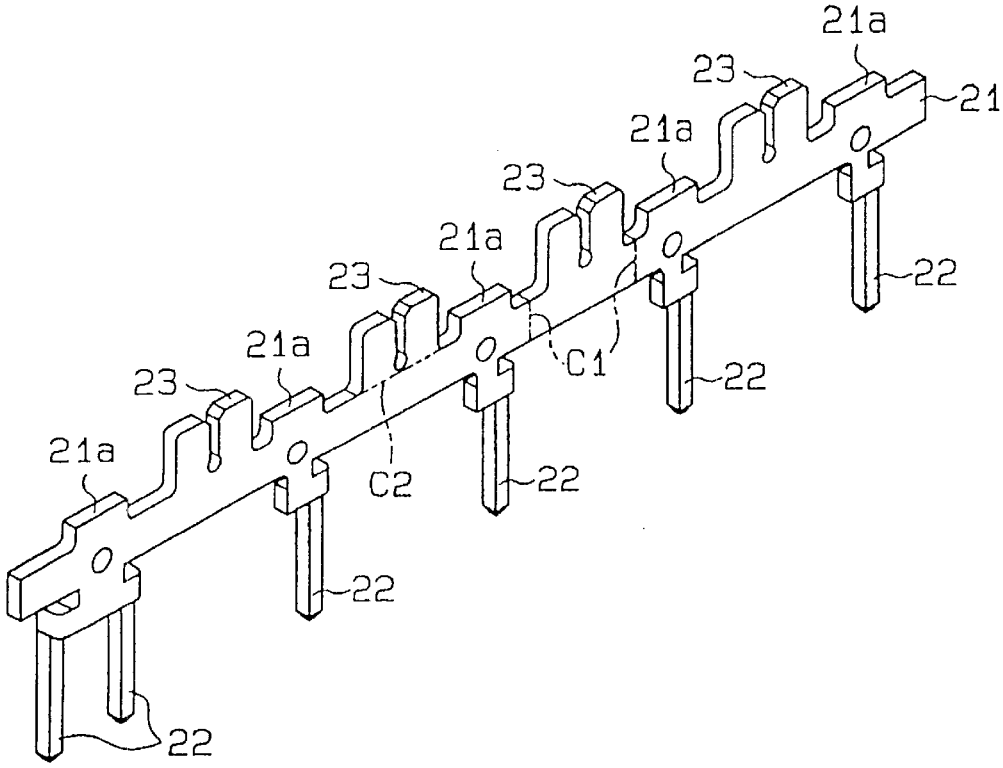
FIG. 6 is a perspective view of a vertical bus bar of the box of FIG. 1, enlarged.

The array 14 of the bus bars is comprised of ten bus bars 15*a*–15*j* each consisting of a one-piece metal plate or sheet lying upright. The bus bars 15*a*–15*j* have similar shapes and configuration and are formed by punching and bending sheet metal. As shown in FIG. 6, each of the bus bars 15*a*–15*j* includes body 21, a plurality of tab terminals 22, a plurality of projections 21*a* and a plurality of pressure connection blades 23. The tab terminals 22 project from the upper side (as defined in FIG. 1) of the body 21 at regular intervals. The pressure connection blades 23 project at regular intervals from the lower side of the body 21, and each is spaced along the body 21 at a position between longitudinal positions of adjacent tab terminals 22. No connection blade 23 is formed at a longitudinal position corresponding to that of the tab terminal 22. The tab terminals 22 and the connection blades 23 are alternately formed along the body 21. A plurality of projections 21*a* are provided at regular intervals on the lower side of the body 21 at longitudinal positions corresponding to the longitudinal positions of the tab terminals 22 positions. The length of the lower edge of each projection 21*a* is greater than the width of a ridge or bar 27 of the lower casing 13.

As shown in FIG. 1, a plurality of connector-receiving housings 24 for installation of components are formed integrally on the upper side of the upper casing 12. As shown in FIG. 2, grooves 25 that accommodate the bus bars 15*a*–15*j* are formed on the lower side of the upper casing 12. These grooves 25 are parallel with one another and spaced at regular intervals.

As shown in FIG. 1, bus bar accommodation grooves 26 are formed on the upper side of the lower casing 13 at positions corresponding to the grooves 25. On the upper surface of the lower casing 13, ridges or bars 27 extend perpendicularly to the grooves 26. These ridges or bars 27 are formed at regular intervals and are substantially parallel with one another. The ridges or bars 27 are at positions corresponding to the positions of the projections 21*a* of the bus bars 15*a*–15*j* when assembled in the grooves 26.

Figure 3:
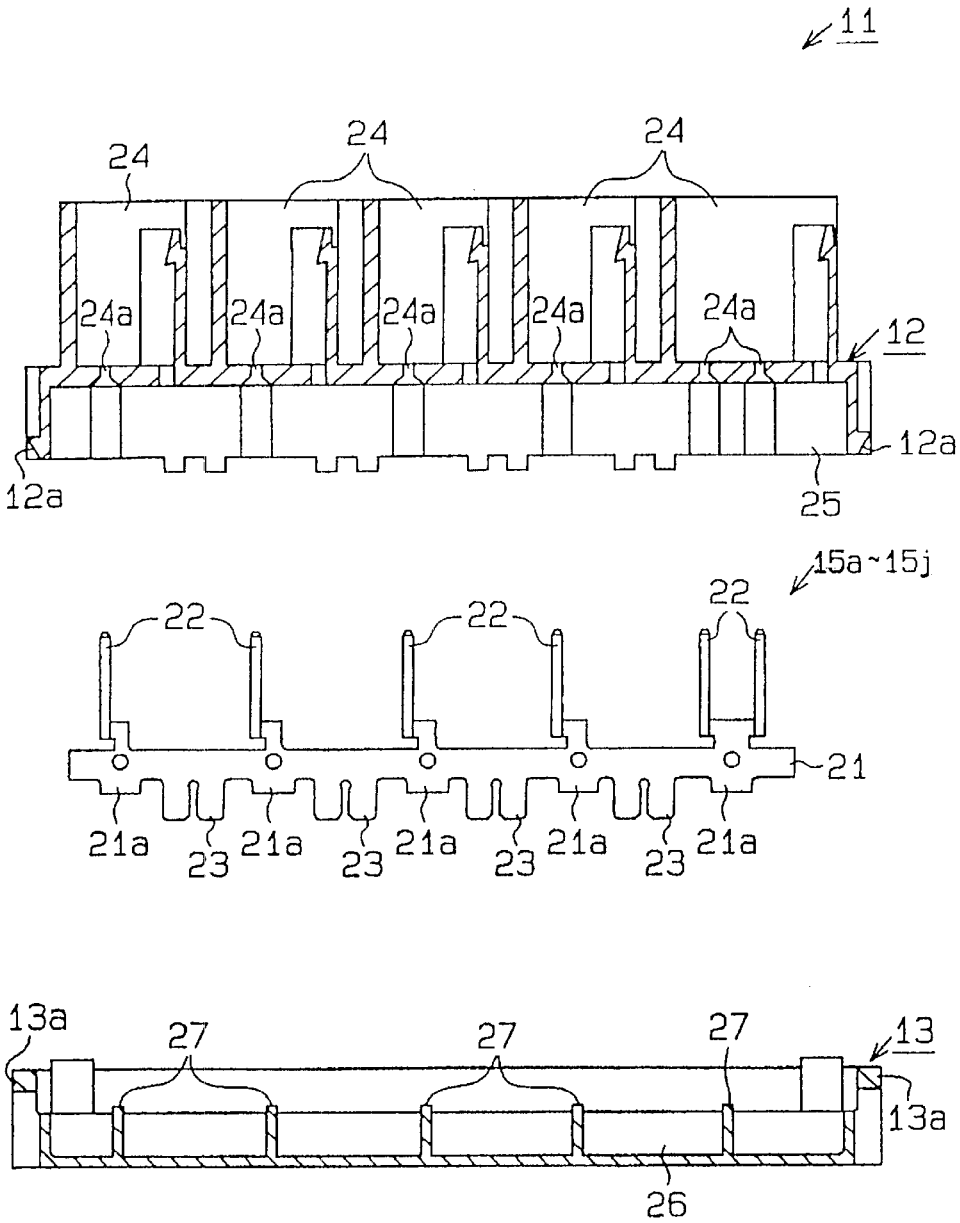
FIG. 3 is a sectional view on line 3—3 of FIG. 1.
Figure 4:
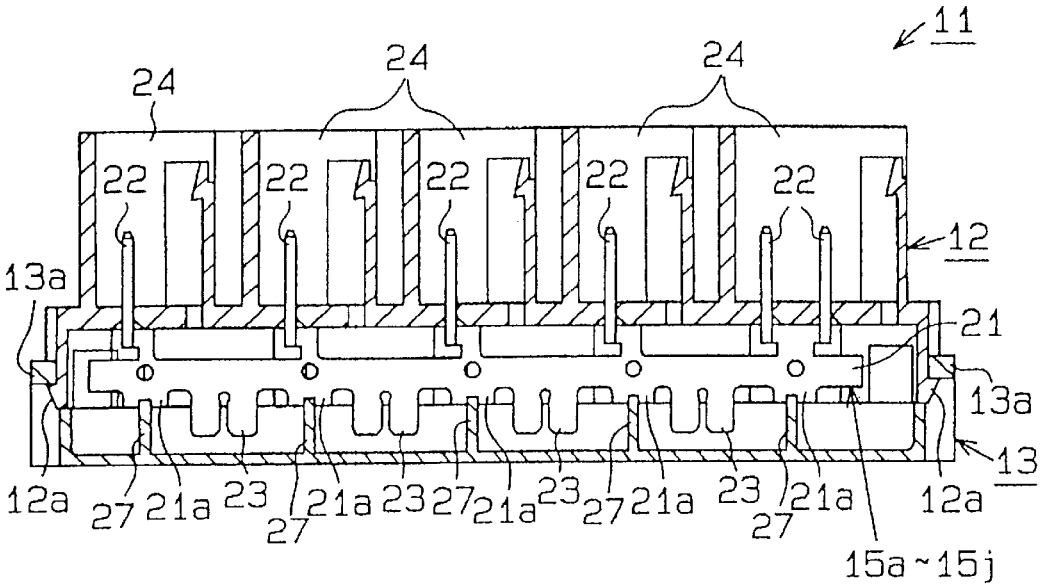
FIG. 4 is a sectional view showing the assembled state of the electric connection box of FIG. 1.
Figure 5:
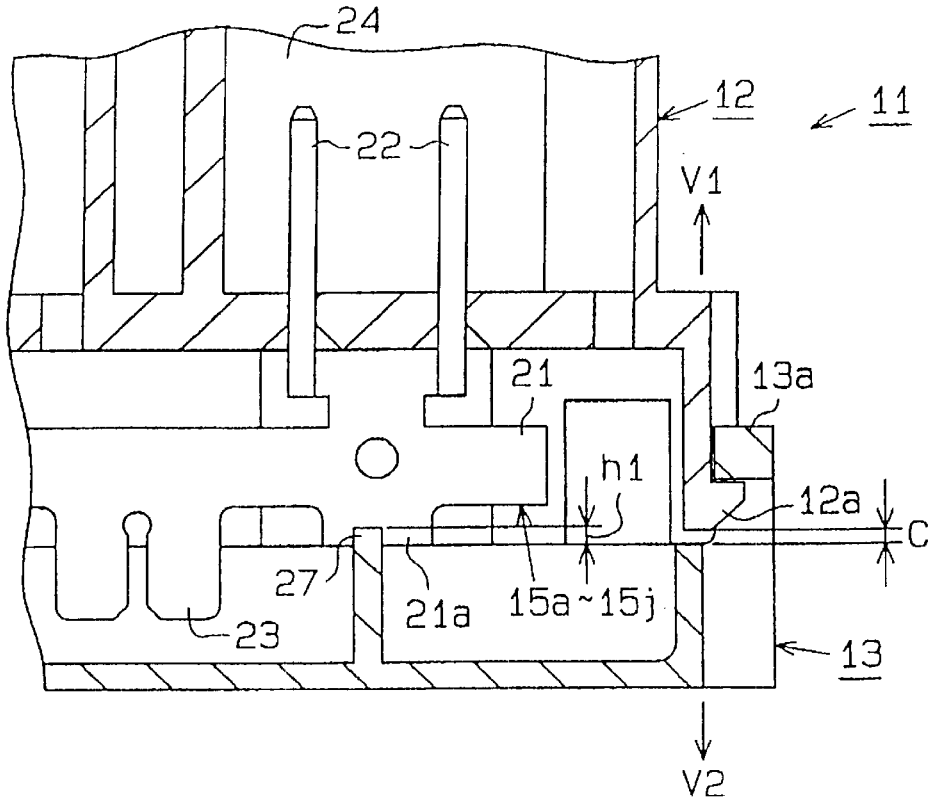
FIG. 5 is a sectional view of a part of FIG. 4 enlarged.

In the electrical connection box 11 having the above-described structure, as shown in FIGS. 1 to 4, the bus bars 15*a*–15*j* are accommodated in the grooves 25, with the tab terminals 22 projecting upwards. The bodies 21 of the bus bars 15*a*–15*j* are perpendicular to the bottom surface of the upper casing 12. As shown in FIGS. 3 to 5, the terminals 22 project through through-holes 24*a* formed through the bottom surface of each of the connector housings 24, while the projections 21*a* and the pressure connection blades 23 are located in rows perpendicular to the longitudinal direction of the bodies 21 of the bus bars.

When it is necessary to design a bus bar circuit by electrically connecting different bus bars 15*a*–15*j*, an electrical wire 31, for example a single-core wire, is pressed against the desired pressure connection blades 23 by means of a pressing machine (not shown). The electrical wire is trapped in and electrically contacts the slots of the pressure connection blades 23 (see FIG. 7). Thereby, the appropriate bus bars 15*a*–15*j* are electrically connected to one another. Because the pressure connection blades 23 are arranged in rows, the electrical wires 31 can run linearly in a direction perpendicular to the longitudinal direction of the bodies 21. In the exemplary embodiment shown in FIG. 2, the bus bars 15*a*–15*c* and the bus bars 15*g*–15*i* are electrically connected to each other respectively, by the two wires 31.

In summary, the lower casing 13 is installed on the bottom face of the upper casing 12. The upper and lower casings 12,13 are locked together by fitting the locking projections 12*a* of the upper casing 12 with the respective locking recesses 13*a* of the lower casing 13. The locking projections components 12*a* and the locking recesses 13*a* have an amount of clearance C (see FIG. 5) to permit them to be fitted together. Upon completion of the attachment of the lower casing 13 to the upper casing 12, as shown in FIG. 5, the ridges or bars 27 of the lower casing 13 press the projections 21*a* of the bus bars 15*a*–15*j*. More specifically, as shown in FIG. 5, upon completion of the attachment of the lower casing 13 to the upper casing 12, each ridge or bar 27 is higher than the lower edge of the projections 21*a* by a small amount h1 (about 0.2 mm in the exemplary embodiment). Therefore, each bar 27 is slightly deformed by the projections 21*a* at their contact points. The natural resilience of the material of the casings maintains a tight contact of the bars 27 during use. Consequently, as shown with the arrow V1 of FIG. 5, the bus bars 15*a*–15*j* are urged upward by the force applied by the bars 27, and the lower casing 13 is urged downward by the reaction force, as shown with the arrow V2 of FIG. 5. Finally, the upper casing 12 is urged upward by the bus bars 15*a*–15*j*. Thus the upper and lower casings 12,13 are urged apart minimizing or eliminating any play or looseness at the locking components. As FIG. 5 shows, mutually abutting faces of the locking projections 12*a* and the locking recesses 13*a* are pressed together to restrain the casings from moving apart.

It is possible to alter the bus bar circuit as desired for a particular use, by cutting off parts of the bus bars 15*a*–15*j*. For example the body 21 may be cut at positions shown by broken lines C1 in FIG. 6, so that the bus bar consists of two electrically divided component parts. Various bus bar circuits can thus be obtained, as shown, for example, in FIG. 7.

Figure 7:
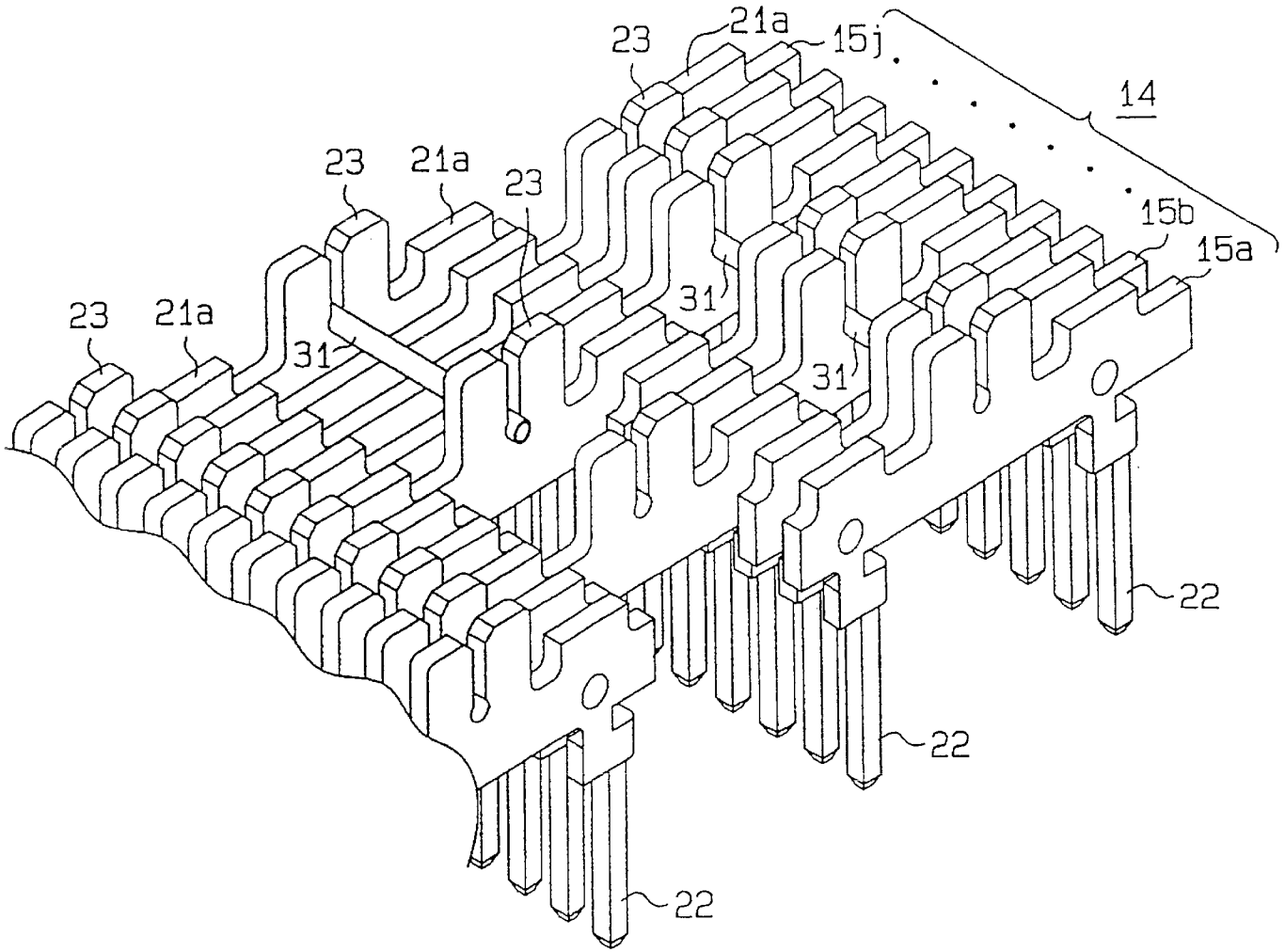
FIG. 7 is a perspective view showing an example of a modification of the bus bar circuit in the box of FIG. 1.
Figure 8:
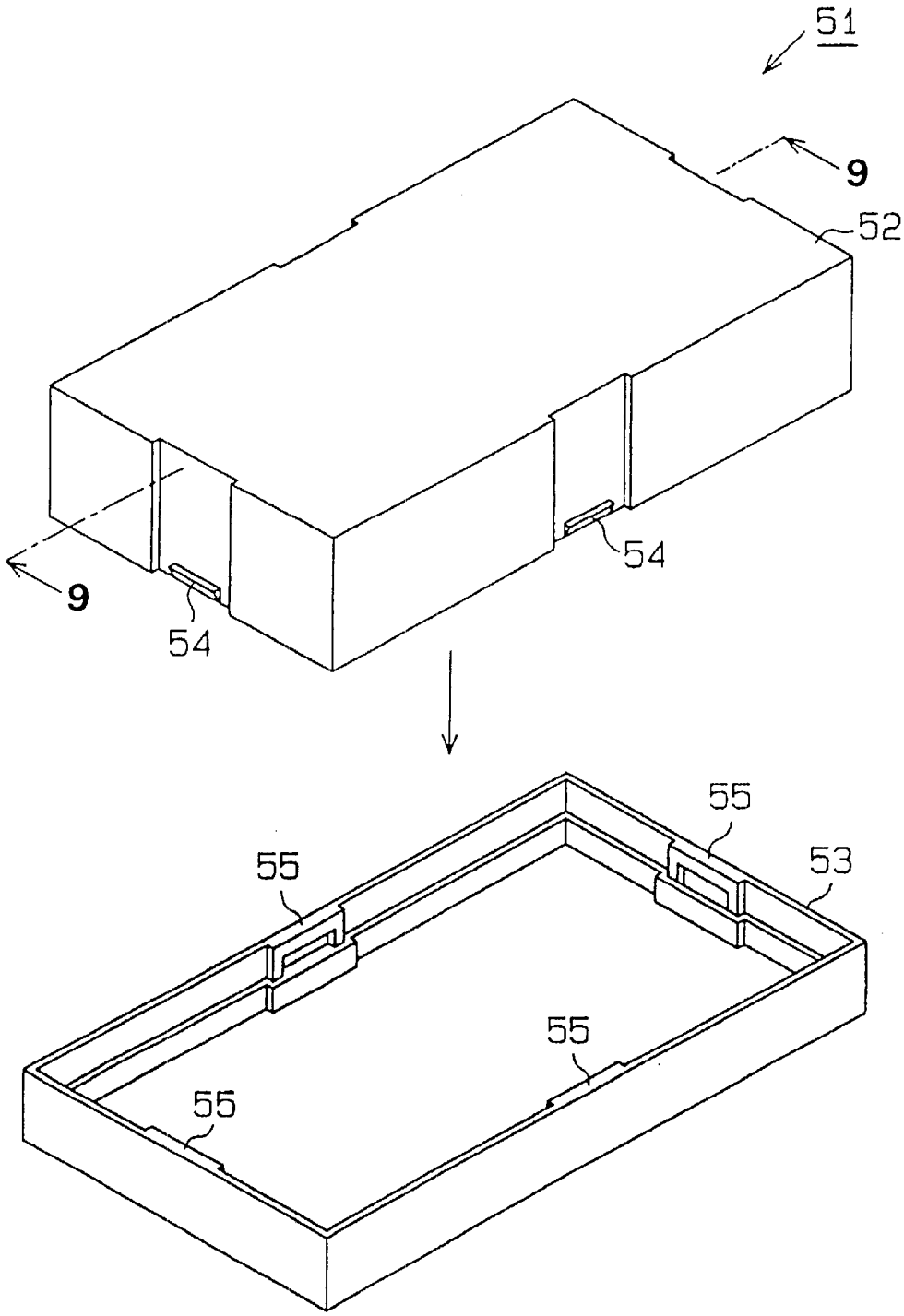
FIG. 8 is an exploded perspective view illustrating generally a problem of an electrical connection box having locking components.
Figure 9:
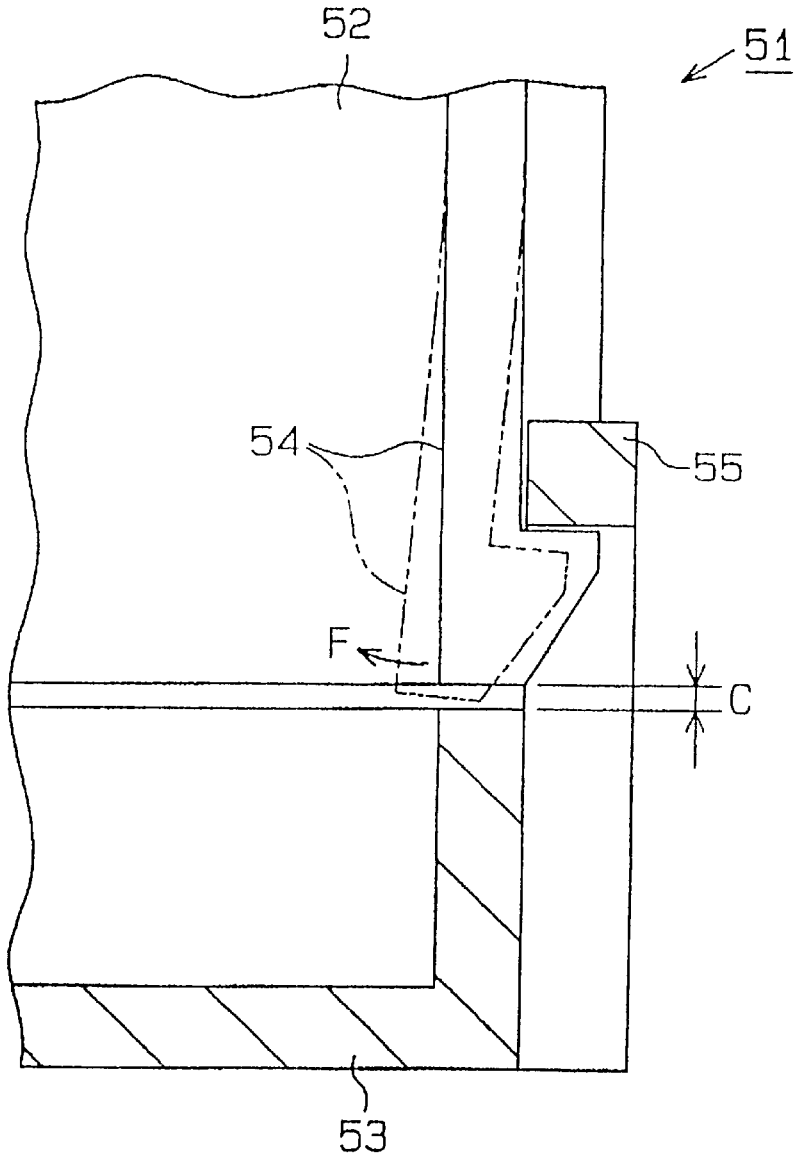
FIG. 9 is a partly enlarged sectional view taken along a line 9—9 of FIG. 8.

When it is necessary to electrically connect non-adjacent bus bars, for example, the bus bars 15*f* and 15*j*, a pressure connection blade 23 of each of the bus bars 15*g*–15*i* is cut off, as shown, for example, in FIG. 7, where each blade 23 is cut off at a position shown with broken line C2 in FIG. 6. In this case, the wire 31 is connected to the blades 23 of only the bus bars 15*f* and 15*j*. Thereby, it is possible to electrically connect the bus bars 15*f* and 15*j* to each other reliably.

Accordingly, the following effects can be obtained in this embodiment.

(1) Upon fitting of the projection 12*a* on the recess 13*a*, the bars 27 press the bus bars 15*a*–15*j* upward, so that the upper and lower casings 12,13 are urged apart, to minimize or prevent looseness between the upper casing 12 and the lower casings 12 despite the clearance provided between the locking projection 12*a* and the recess 13*a*.

(2) The pressure between the ridge or bars 27 and the bus bars 15*a*–15*j* prevents the bus bars 15*a*–15*j* from being loose in the electric connection box 11. The bus bars are securely held at predetermined positions in the electric connection box 11.

(3) The ridges or bars 27 extend in parallel at regular intervals in a direction perpendicular to the longitudinal direction of the bus bars 15*a*–15*j*. Thus, all the bus bars 15*a*–15*j* are pressed by each of the ridges or bars 27. The upper and lower casings 12,13 are urged apart in a balanced manner at a plurality of spaced locations, to minimize or prevent looseness between the upper and lower casings 12,13.

(4) Each bus bar 15*a*–15*j* has pressure connection blades 23. Thus, the bus bars 15*a*–15*j* can be electrically connected to each other in a simple manner through electric wires 31 by pressing the wires 31 against the blades 23. This eliminates a need for connection terminals for wires which fit on tab terminals 22 in known electrical connection boxes. Thus, it is easy to electrically connect the bus bars 15*a*–15*j*. It is also easy to design or alter the bus bar circuit.

Further, as the bus bars 15*a*–15*j* are prevented from becoming loose, the risk that an electrical wire 31 will be separated from a blade 23 is reduced. Accordingly, the reliability of the connection between the electric wire 31 and the bus bars 15*a*–15*j* is improved.

(5) A plurality of projections 21*a* on each of the bus bars 15*a*–15*j* contact the ridges or bars 27 when properly positioned in the upper casing 12. Therefore, it is possible to assure the location of the bus bars 15*a*–15*j* in the upper casing, by first assembling the bus bars 15*a*–15*j* and the upper casing 12, thereby preventing defective positioning of the bus bars 15*a*–15*j*. If the projections 21*a* project from the bottom surface of the upper casing 12, they can be reliably brought into contact with the ridges or bars 27. Further, because the length of the lower edges of the projections 21*a* is greater than the width of the ridges or bars 27, the ridges or bars 27 can be reliably brought into contact with the projections 21*a*.

(6) Each projection 21*a* is at a position corresponding to a longitudinal position of a tab terminal 22, and is supported by one of the ridges or bars 27. Thus, even when an insertion force of an electrical component is applied to the tab terminal 22 upon connection of an electrical component, the risk that a tab terminal 22 is depressed in the casings 12,13 is minimized. Thus, the risk of defective connection of an electrical component on the tab terminal 22 is substantially reduced.

(7) The top of a ridge or bar 27 is higher than the lower edge of a projection 21*a* by a small amount h1, for example 0.2 mm, upon locking of the lower casing 13 to the upper casing 12. If this height h1 is too large, it may be difficult to fit locking projection 12*a* in the locking recess 13*a*. If the height h1 is too small, the ridge or bar 27 may not be deformed sufficiently for the desired effect. Thus, by setting the height hi to about 0.2 mm in this example, it is possible to deform the ridges or bars 27 reliably, without making fitting of the projection 12*a* in the recess 13*a* difficult.

While the invention has been described in conjunction with the exemplary embodiment described above, many equivalent modifications and variations will be apparent to those skilled in the art when given this disclosure.

The following variations are mentioned as examples:

(1) The projections 21*a* may be omitted to allow each of the bus bars 15*a*–15*j* to have a more simplified structure, with the ridges or bars 27 contacting the bodies 21 of the bus bars directly.

(2) The ridges or bars 27 may be omitted and instead, abutments equivalent to the ridges or bars 27 may be formed on the bottom surface of the upper casing 12 to act as the abutment portions. That is, the abutments may be on the upper casing 12 or the lower casing 13.

(3) The abutment is not limited to the bar 27. It is possible to form a narrow projection in correspondence to each projection 21*a*.

(4) The recesses 13*a* may be on the upper casing 12 and the locking projection 12*a* on the lower casing 13.

(5) The bar 27 is higher than the lower edge of the projection 21*a* by a height h1 of 0.2 mm upon connection of the lower casing 13 on the upper casing 12 and elimination of play at the locking components. However, this height hi is not limited to 0.2 mm, but for example may be in the range of 0.1 to 0.5 mm.

(6) The tab terminals 22 may be formed on both sides of the body 21. That is, each of the bus bars 15*a*–15*j* may have the tab terminal 22 extending vertically upwards and downwards from the body 21.

Accordingly, the exemplary embodiments of the invention set forth above are considered to be illustrative and not limiting. Various changes to the described embodiments may be made without departing from the spirit and scope of the invention.

What is claimed is:

1. An electrical connection box comprising a first casing;

a second casing;

mutually engageable locking components on said first casing and said second casing for locking said first casing and said second casing together in an assembled condition;

a plurality of bus bars assembled in one of the first and second casings; and at least one abutment, formed as an integral part of another of said first and second casings, the at least one abutment pressing on a surface of said bus bars in a direction in which said first and second casings are urged apart such that the position of said bus bars is maintained and said bus bars urge said casings apart against a restraint of said locking components in said assembled condition.

2. The electrical connection box according to claim 1, wherein said bus bars have longitudinal body portions of flat shape arranged upright in an array alongside each other and extending substantially parallel to each other in a longitudinal direction, said electrical connection box having a plurality of said abutments in the form of longitudinal members each extending across the array of bus bars substantially perpendicular to said longitudinal direction of said bus bars, said members being spaced apart from each other along the length of said bus bars.

3. The electrical connection box according to claim 1, wherein each said bus bar has, on an upper side at least one upwardly extending tab terminal for connection of an electrical component, and has on a lower side, at least one downwardly extending pressure connection blade for making a pressure connection with an electrical wire.

4. An electrical connection box, comprising a first casing;

a second casing;

mutually engageable locking components on said first casing and said second casing for locking said first casing and said second casing together in an assembled condition;

a plurality of bus bars assembled in one of the first and second casings, each of said bus bars including a plurality of pressure connection blades; and at least one abutment, formed as an integral part of at least one of said first and second casings, which presses on said bus bars in a direction in which said first and second casings are urged apart such that the position of said bus bars is maintained and said bus bars urge said casings apart against the restraint of said locking components wherein at least two bus bars are electrically connected by an electrical wire pressed between at least one of the pressure connection blades of each of the at least two bus bars.

5. The electrical connection box according to claim 4, wherein said bus bars have longitudinal body portions of flat shape arranged upright in an array alongside each other and extending substantially parallel to each other in a longitudinal direction, said electrical connection box having a plurality of said abutments in the form of longitudinal members each extending across the array of bus bars substantially perpendicular to said longitudinal direction of said bus bars, said members being spaced apart from each other along the length of said bus bars.

* * * * *